US009021660B2

(12) United States Patent
Ramsauer

(10) Patent No.: US 9,021,660 B2
(45) Date of Patent: May 5, 2015

(54) HANDLE, EYE, OR CLOTHES HOOK HAVING A MOUNTING PLATE AND PIVOT BEARING

(76) Inventor: Dieter Ramsauer, Schwelm (DE)

( * ) Notice: Subject to any disclaimer, the term of this patent is extended or adjusted under 35 U.S.C. 154(b) by 765 days.

(21) Appl. No.: 12/738,358

(22) PCT Filed: Sep. 13, 2008

(86) PCT No.: PCT/EP2008/007616

§ 371 (c)(1),
(2), (4) Date: Jun. 8, 2010

(87) PCT Pub. No.: WO2009/052907

PCT Pub. Date: Apr. 30, 2009

(65) Prior Publication Data

US 2010/0257697 A1 Oct. 14, 2010

(30) Foreign Application Priority Data

Oct. 19, 2007 (DE) ..... 20 2007 014 728 U

(51) Int. Cl.
*A47B 95/02* (2006.01)
*E05B 1/00* (2006.01)

(52) U.S. Cl.
CPC ..... *E05B 1/0015* (2013.01)

(58) Field of Classification Search
CPC ..... E05B 1/00; E05B 1/0015; A47B 95/02
USPC ..... 16/413, 415, 419, 422, 110.1, 445, 443, 16/406, 416, 412
See application file for complete search history.

(56) References Cited

U.S. PATENT DOCUMENTS

| | | | | |
|---|---|---|---|---|
| 980,193 | A * | 1/1911 | Brenia | 16/419 |
| 2,420,277 | A * | 5/1947 | Wulstein | 220/751 |
| 2,594,027 | A | 4/1952 | Jakeway | |
| 3,189,938 | A * | 6/1965 | Saunders | 16/419 |
| 3,248,750 | A * | 5/1966 | Black | 16/419 |
| 3,621,510 | A * | 11/1971 | Rollins | 16/422 |
| 4,404,709 | A * | 9/1983 | Janz et al. | 16/444 |
| 4,589,163 | A * | 5/1986 | Weatherby et al. | 16/443 |
| 4,641,986 | A * | 2/1987 | Tsui et al. | 403/164 |
| 5,248,176 | A * | 9/1993 | Fredriksson | 294/215 |
| 5,585,578 | A * | 12/1996 | Shimotori | 84/95.2 |
| 5,625,921 | A | 5/1997 | Smith | |
| 6,421,882 | B1 * | 7/2002 | Liao et al. | 16/445 |
| 6,789,294 | B2 * | 9/2004 | Panek et al. | 16/409 |
| 7,062,818 | B2 * | 6/2006 | Jeffries | 16/445 |
| 8,001,656 | B2 * | 8/2011 | Ramsauer | 16/416 |
| 2008/0127458 | A1 * | 6/2008 | Ramsauer | 16/412 |

FOREIGN PATENT DOCUMENTS

| | | |
|---|---|---|
| EP | 1 125 790 | 8/2001 |
| FR | 2 648 526 | 12/1990 |
| GB | 417 015 | 9/1934 |

(Continued)

*Primary Examiner* — Emily Morgan
(74) *Attorney, Agent, or Firm* — Frommer Lawrence & Haug LLP

(57) ABSTRACT

A handle has at least one fastening plate or holding part which can be fastened in a through-hole in a thin wall such as a sheet-metal wall by means of snap devices. According to the invention, the fastening plate forms or carries a pivot bearing for the at least one end of a handle, or the like, which is bent, for example, from a round material such as thick wire, this end having a round cross section.

3 Claims, 9 Drawing Sheets

(56) References Cited

FOREIGN PATENT DOCUMENTS

| | | | | |
|---|---|---|---|---|
| WO | WO 2005071198 A1 * | 8/2005 | ..... | E05D 5/02 |
| WO | WO 2005/083207 | 9/2005 | | |
| WO | WO 2005083207 A1 * | 9/2005 | ..... | E05B 1/00 |
| WO | WO 2006032403 A1 * | 3/2006 | ..... | E05B 1/00 |
| WO | WO 2009052907 A1 * | 4/2009 | | |

* cited by examiner

C-C

B-B
Z

A-A

Z (20 : 1)

C-C

B-B

A
A

A-A

B-B
Z

C-C

C
C

B
B 16
42
224

Z ( 20 : 1 )
244
212
46
42
220
222
48
ØA
ØB

C-C

Z ( 20 : 1 )
ØA
ØB

B-B
Z

A-A

A
A

C
C

B
B

C-C

Z ( 20 : 1 )
ØA
ØB
C
442

B-B
Z

442

A-A

A
A
C
C

B
B 927
912
926
918
930
936
16

910
924
16
926

66
918

918

912

62
920
922
64
918

1018

1010
1024
16

1024

1020
1022
1024
1018
62

1024
1018
36
34

A
A
1024
1012

16
1018
1024
A-A
1018
34

HANDLE, EYE, OR CLOTHES HOOK HAVING A MOUNTING PLATE AND PIVOT BEARING

The present application claims priority from PCT Patent Application No. PCT/EP2008/007616 filed on Sep. 13, 2008, which claims priority from German Patent Application No. DE 20 2007 014 728.7 filed on Oct. 19, 2007, the disclosure of which is incorporated herein by reference in its entirety.

BACKGROUND OF THE INVENTION

1. Field of the Invention

The invention is directed to a handle or eyelet or clothes hook with at least one fastening plate which can be secured in a through-hole in a thin wall such as a sheet-metal wall by means of snap devices.

2. Description of Related Art

A handle of the type mentioned above is already known from WO2005/083207 A1.

A drawback of this known handle is that it cannot be folded away.

SUMMARY OF THE INVENTION

It is the object of the invention to modify the known handle in such a way that it can be folded away so that it no longer protrudes in a troublesome manner.

The above-stated object is met in that the fastening plate forms or carries a pivot bearing for the at least one end of a handle, or the like, which is bent from thick wire, for example, this end having a round cross section.

A handle of the kind mentioned above can be used as a carrying handle but, on the other hand, can also be folded away in one direction at least far enough that it rests flat against the fastening surface and no longer protrudes.

According to a further development of the invention, the fastening plate carries or forms at least one stop for the at least one end of the handle, or the like.

Because of the stop, it is possible to provide a ramp or a stop on the other side of the fastening plate so as to allow the handle to stick out so that it can be grasped more easily from the fastening surface. The angle at which the handle stops before it has reached its flat position can be determined by an appropriate choice of the stop height.

In larger, longer handles, two holding parts can also be used.

In an embodiment form of this kind, it is advantageous that two fastening plates are each provided with a pivot bearing for the two ends of the handle made of wire.

As in the prior art, the snap device comprising two metal plates which axe supported in the fastening plate in opposite directions against spring force is advantageously outfitted at the free end face of the metal plate with a flat inclined run-in surface and with a steep inclined holding surface having a self-locking action, which holding surfaces cooperate with the edge of the through-hole as snap device, and wherein the metal plates project into the bearing space of the wire end in such a way that they are fixed axially. By means of this step, the metal plates achieve a dual use for holding the holding plate at the thin wall on the one hand and for axially fixing the handle in the holding plate on the other hand.

To ensure that the handle remains stationary in every possible position and, further, to reduce rattling noises under vibration load, it is advantageous when the pivot bearing is formed according to another embodiment form by a groove or notch which opens toward the thin wall and whose depth is slightly smaller than the diameter of the round material or of the end of the wire so that the handle remains stationary in every desired position owing to the friction and clamping between the end of the wire and the wall.

According to an alternative design, the pivot bearing is formed by a groove or notch which opens toward the thin wall and whose depth is slightly smaller than the diameter of the wire and a base which is additionally provided, so that the handle remains stationary in every desired position owing to the friction and clamping between the end of the wire and the base contacting the wall.

The base has the further advantage that the handle maintains a distance if desired, which can be advantageous in certain applications.

The stop can also be arranged in such a way that it can be configured for different stop positions.

The wire can be bent in a C-shape and be, for example, a lashing lug.

Another possibility consists in that the wire can deviate from the C-shape by the formation of a loop such that it has the shape, for example, of a clothes hook.

Accordingly, if for some reason it is not desirable to let the round handle part rest on the sheet-metal wall, an additional base part can also be used. This is also possible if for some reason more distance is required between the sheet-metal wall and the handle or another user article having a round cross section at least in the bearing area.

The movement direction of the metal plate can be parallel or perpendicular to the axis of the pivot bearing.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figures 1A, 1B, 1C, 1D, 1E, 1F, 1G, 1H, 1I:
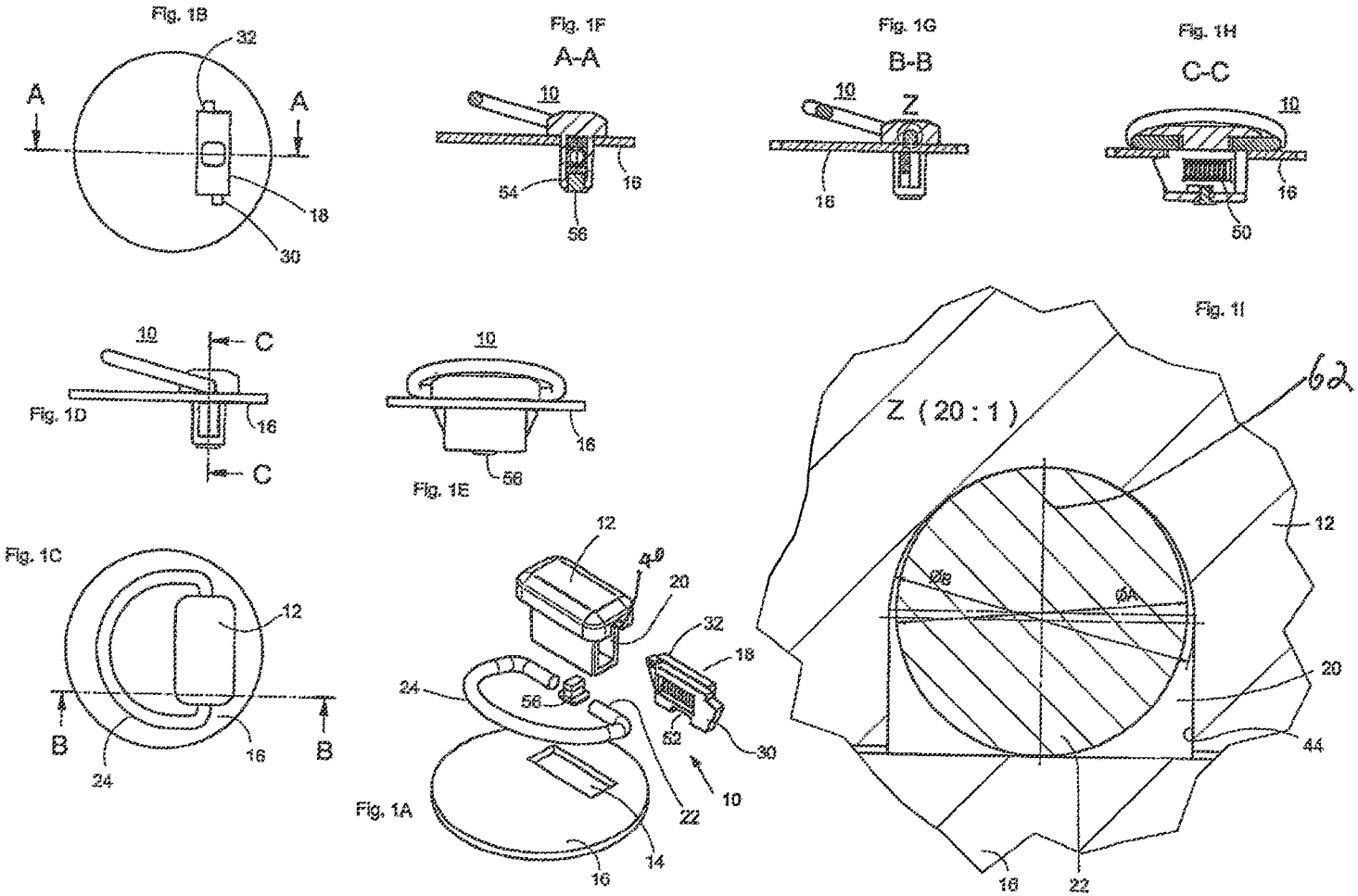
FIG. 1A shows an exploded view of a handle device, in this case in the form of a lashing lug or handle, which can be mounted in a thin wall.
FIG. 1B shows a rear view of the mounted handle.
FIG. 1C shows a top view of the mounted handle.
FIG. 1D shows a side view of the narrow side of the handle.
FIG. 1E shows a side view of the broad side of the handle.
FIG. 1F shows a sectional view along line A-A of FIG. 1B.
FIG. 1G shows a sectional view along line B-B of FIG. 1C.
FIG. 1H shows a sectional view along line C-C of FIG. 1D.
FIG. 1I shows an enlarged view of area Z from FIG. 1G.
Figure 1K:
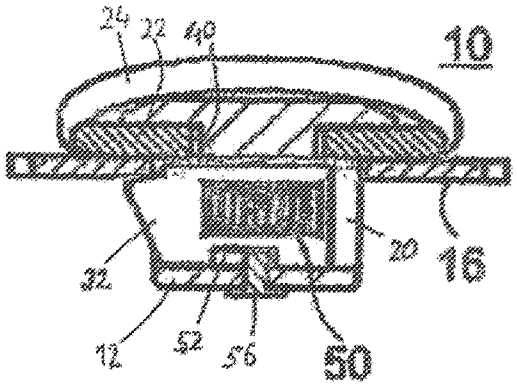
FIG. 1K shows an enlarged view of FIG. 1H.
Figure 1J:
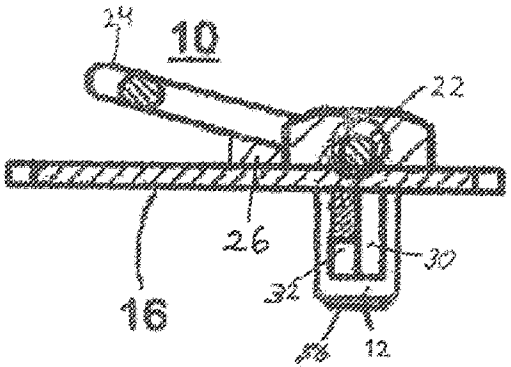
FIG. 1J shows an enlarged view of FIG. 1G.

FIG. 1A is an exploded view of a first embodiment form of a handle or lashing lug designed according to the invention comprising the handle 10 with at least one fastening plate or holding part 12. The fastening plate can be secured in a through-hole 14 in a thin wall 16 such as a sheet-metal wall by means of snap devices 18. The fastening plate 12 is a pivot bearing 20 for the at least one end 22 of a handle 24 which is bent, for example, from round material such as thick wire.

Figure 5B:
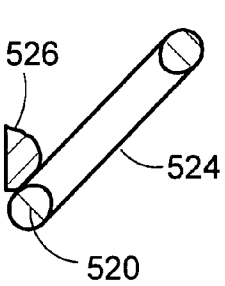
FIG. 5B shows a side view of the embodiment form from FIG. 5A.
Figure 5A:
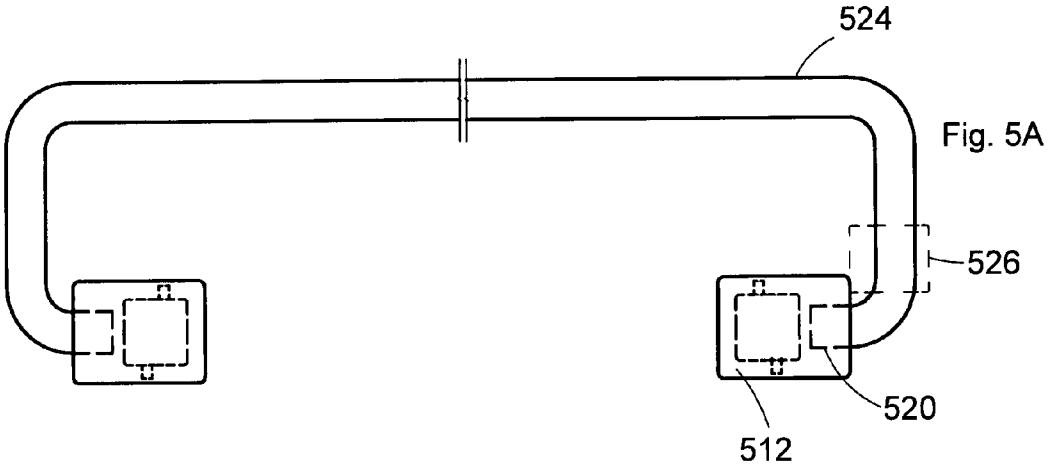
FIG. 5A shows an embodiment form for a longer handle in a top view.

The embodiment form shown in FIGS. 1A to 1I is a handle or lashing lug of relatively short length in which one holding part is sufficient for receiving both ends of the handle. For larger, longer handles such as that illustrated in FIG. 5A, two holding parts 512 can also be used. As can be seen from FIG. 5B and also FIG. 5A, the holding plate 512 supports in one piece a stop device 526 for the at least one end of the handle 524 (see also FIG. 5B). Further illustrations are found in FIGS. 6, 7 and 8. Accordingly, the stops 626 according to FIG. 6 can be designed in such a way that they are suitable for any required positions. In the embodiment form according to FIG. 6, the stop is shaped in such a way that an angle X is formed between the stop surface 626 and the fastening surface or thin wall 616. The angle X is greater in FIG. 6 than in FIG. 7 due to the different arrangement of the stop surface 726 and 626, respectively.

Figure 8:
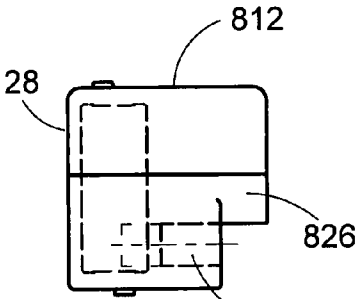
FIG. 8 shows a view in which the holding metal plates simultaneously secure the holding plate in the through-hole of the thin wall and the handle in the holding plate.
Figure 7:
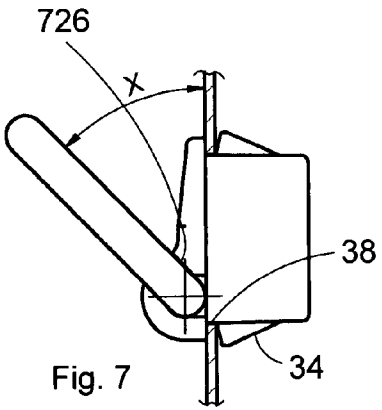
FIG. 7 shows the embodiment form from FIG. 6 with installed handle.
Figure 6:
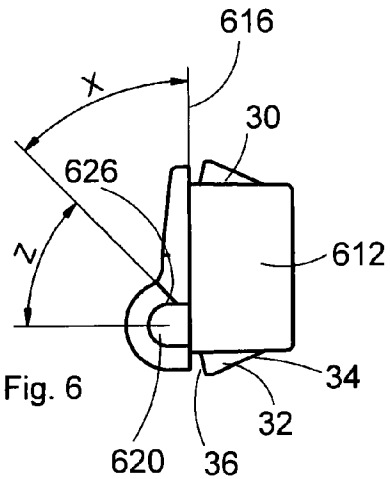
FIG. 6 shows a side view of the embodiment form from FIG. 5A illustrating the stop device.

FIG. 8 is a top view of the holding part from FIG. 7 and FIG. 6 and shows a holding part with a ramp or contact surface 826 which is particularly advantageous when using the handle. In this case, the snap device 618 comprises two slides 30, 32 or metal plates which are supported in the fastening plate 612 in opposite directions against spring force, each slide 30, 32 having a flat inclined run-in surface 34 and a steep inclined holding surface 36 having a self-locking action. The free end faces of the slide 32 and 30, respectively, are surfaces 34, 36 which cooperate with the edge 38 to form the snap device. The slides 32, 30 project into the bearing space 40 of the pivot bearing 20 of the wire end or ends 22 of the handle 10 in such a way that they can be fixed axially so as to enable a preassembly in which the holding parts are already articulated at the handle. As is shown, for example, in FIG. 6, the pivot bearing is formed by a groove or notch 44 which opens toward the thin wall and whose depth is slightly smaller than the diameter of the wire (see, e.g., FIG. 11), Owing to this step, the handle is subjected to a clamping or friction between the end of the wire and the wall so that the handle remains stationary in every desired position owing to the friction.

Figures 2A, 2B, 2C, 2D, 2E, 2F, 2G, 2H, 2I:
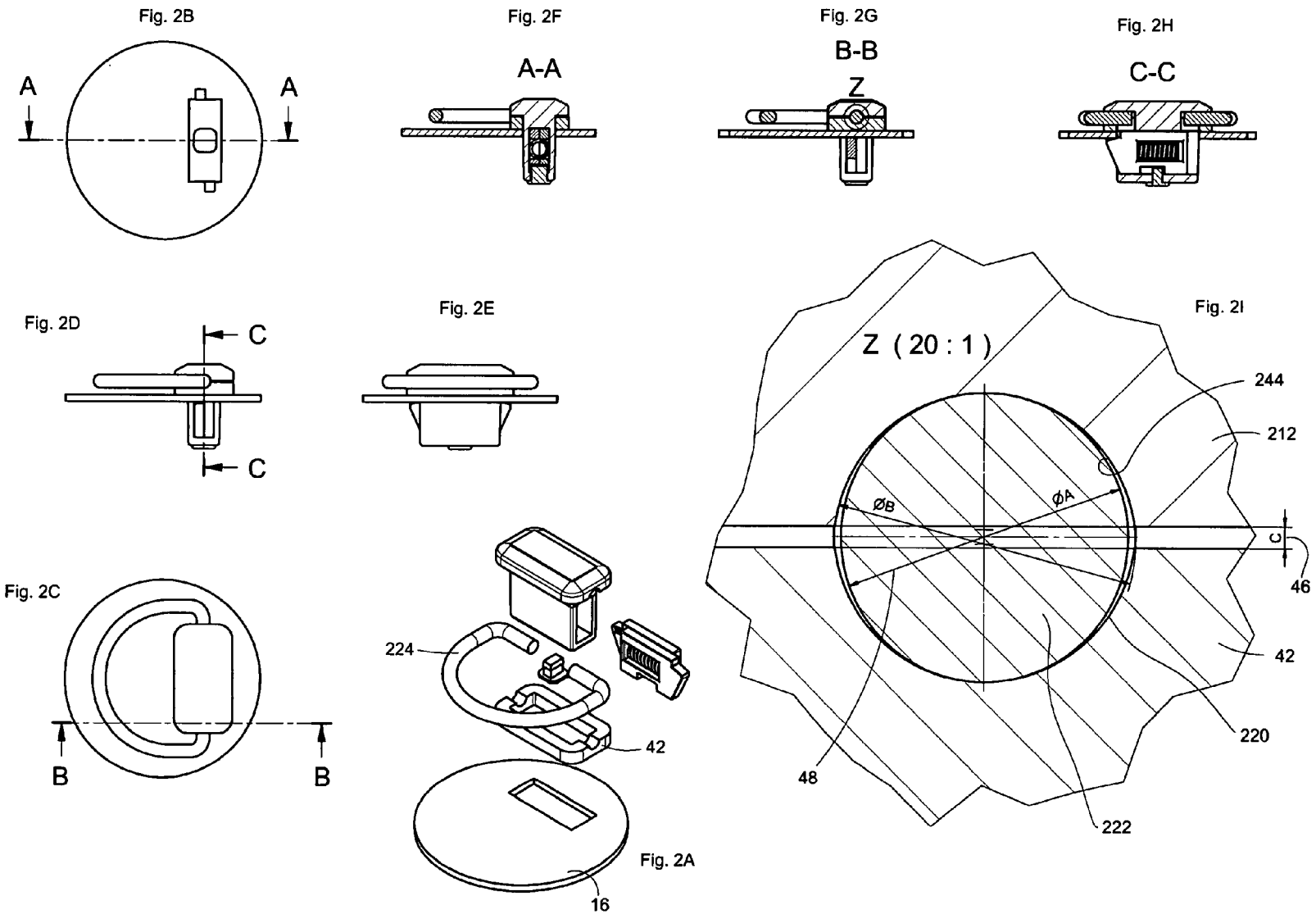
FIGS. 2A to 2I show corresponding views of an embodiment form with base part.
Figures 3A, 3B, 3C, 3D, 3E, 3F, 3G, 3H, 3I:
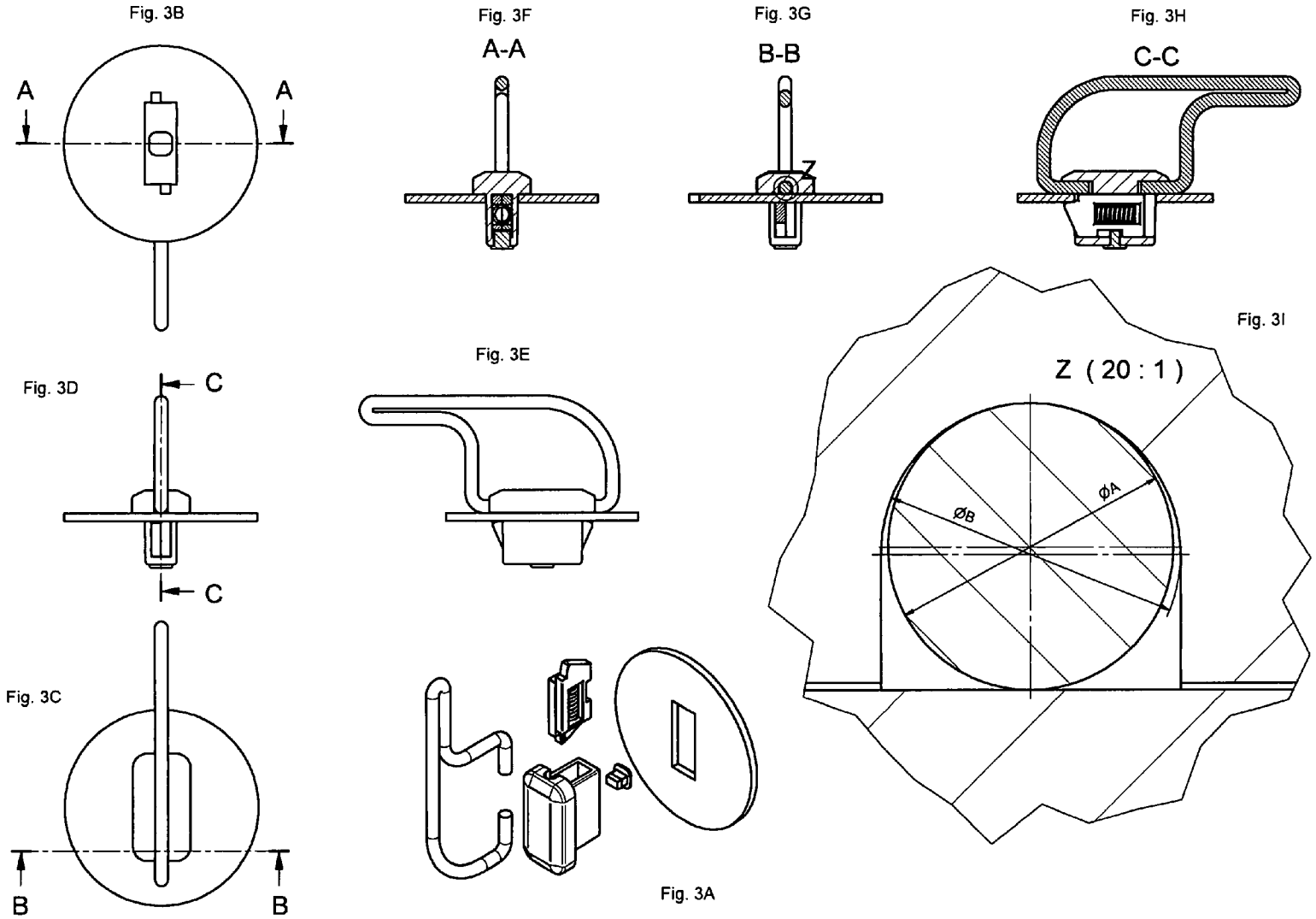
FIGS. 3A to 3I show corresponding views of an embodiment form which is suitable as a clothes hook.
Figures 4A, 4B, 4C, 4D, 4E, 4F, 4G, 4H, 4I:
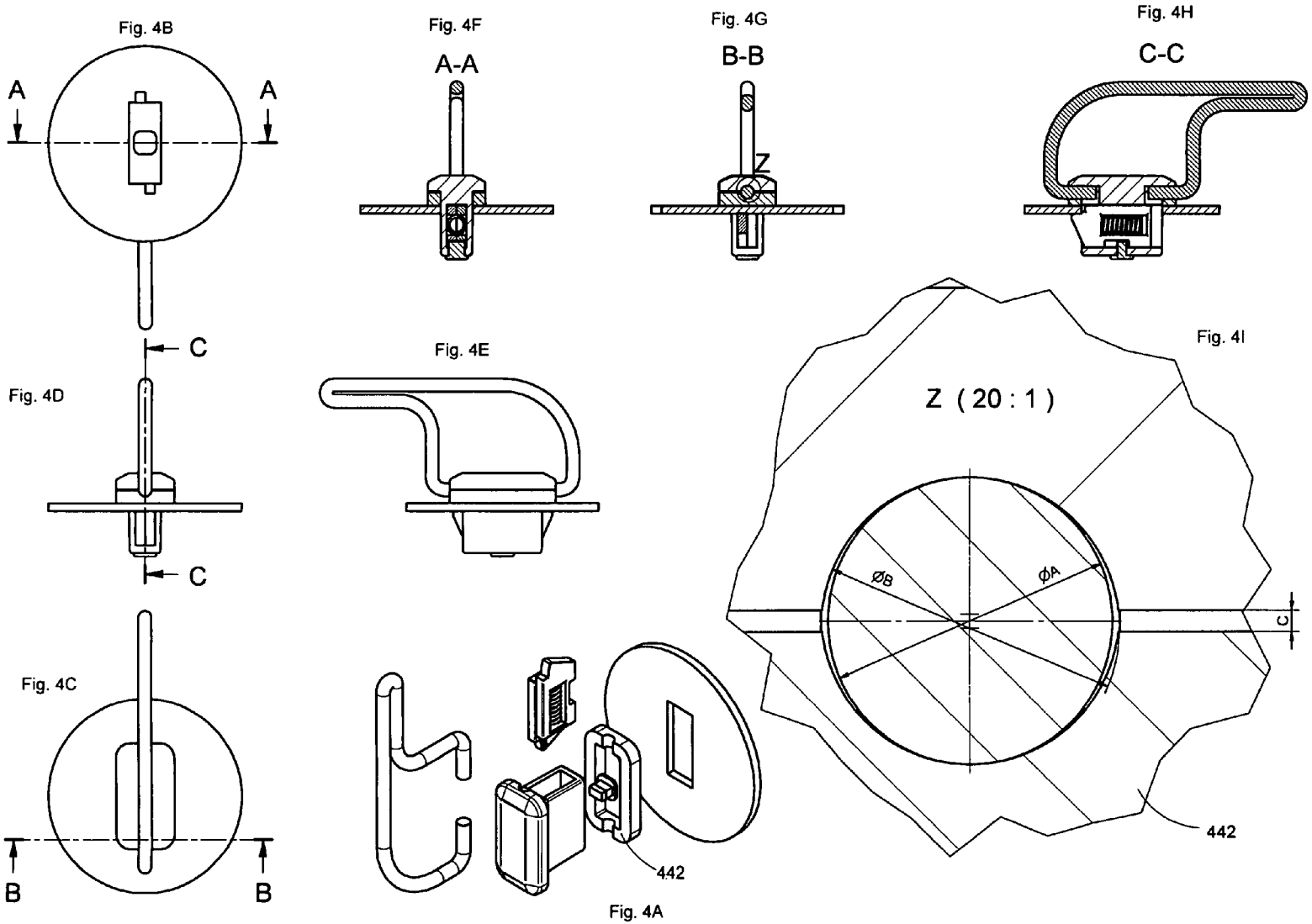
FIGS. 4A to 4I show a clothes hook arrangement with base part.

As is shown in FIG. 2A, the pivot bearing 220 can be formed along with a base 42. In this case also, the pivot bearing 220 is formed by a half-circular groove or notch 244 which opens toward the thin wall and whose depth (see dimension 46) is slightly smaller than the diameter 48 of the wire 224 and a base 42 which is additionally provided. In this case also, the handle is held in any desired position due to the friction and clamping between the end of the wire and the base 42 contacting the wall 16.

In the embodiment form in FIGS. 1A to 1I and 2A to 2I, the wire is bent in a C-shape to form a handle or a lashing lug. In the embodiment form according to FIGS. 3A to 3I and 4A to 4I, a loop is added to the C-shape and acts as a foldable clothes hook. The difference between the two embodiment forms again consists in the use of a base 442 which ensures a distance from the thin wall.

The metal plates 30, 32 can have notches 52 so that they can be pulled back by means of a wrench in order to disassemble the handle which is arranged through a rear opening 52 in the fastening plate 12. The opening 54 can be closed by a plug 56 which can simultaneously limit the axial movement of the metal plates 30, 32.

Figures 9A, 9B, 9C, 9D, 9E, 9F:
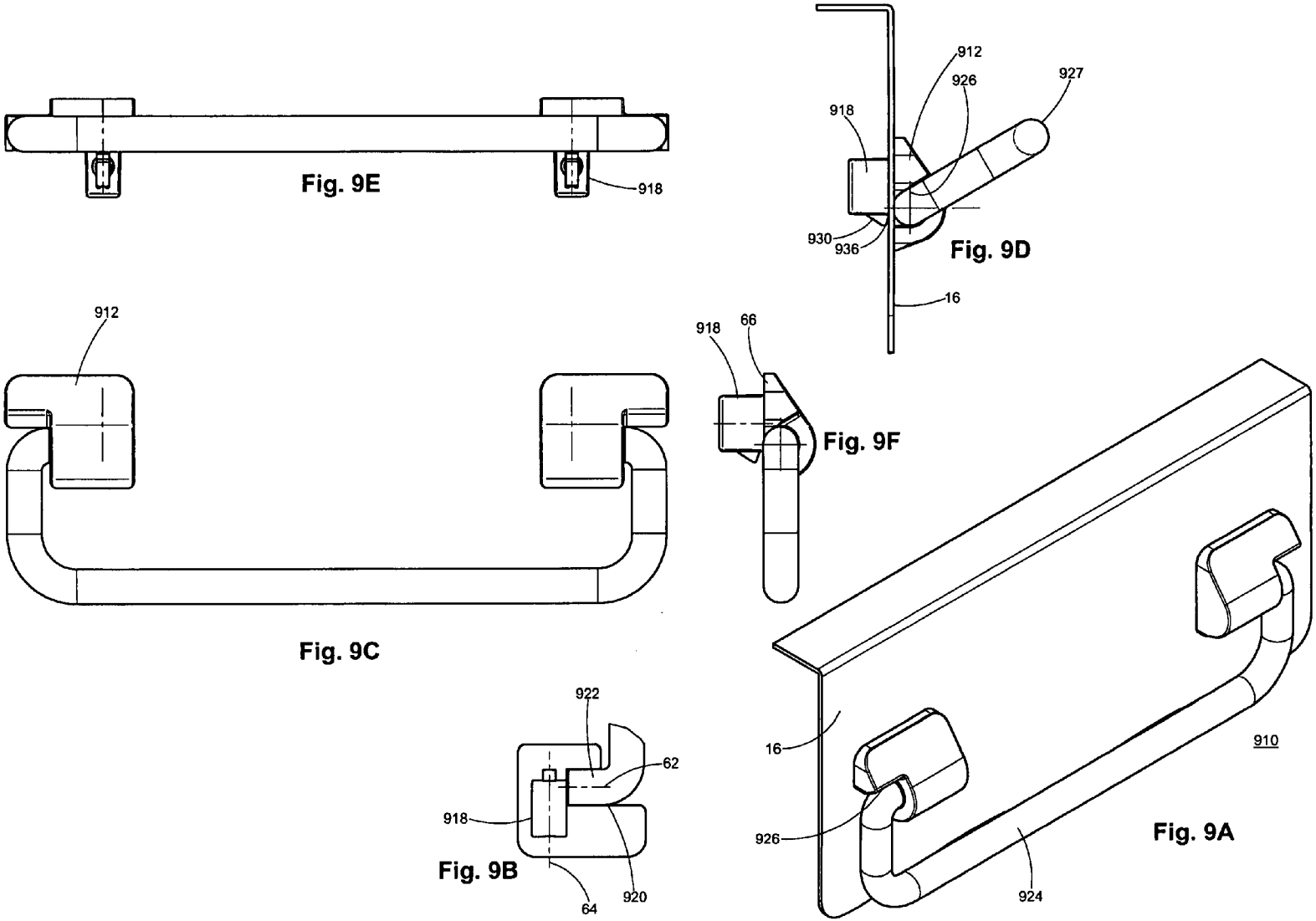
FIGS. 9A to 9F show an embodiment form with a C-shaped handle whose ends are held in a holding part with pivot bearing and stop.
Figures 10A, 10B, 10C, 10D, 10E, 10F, 10G:
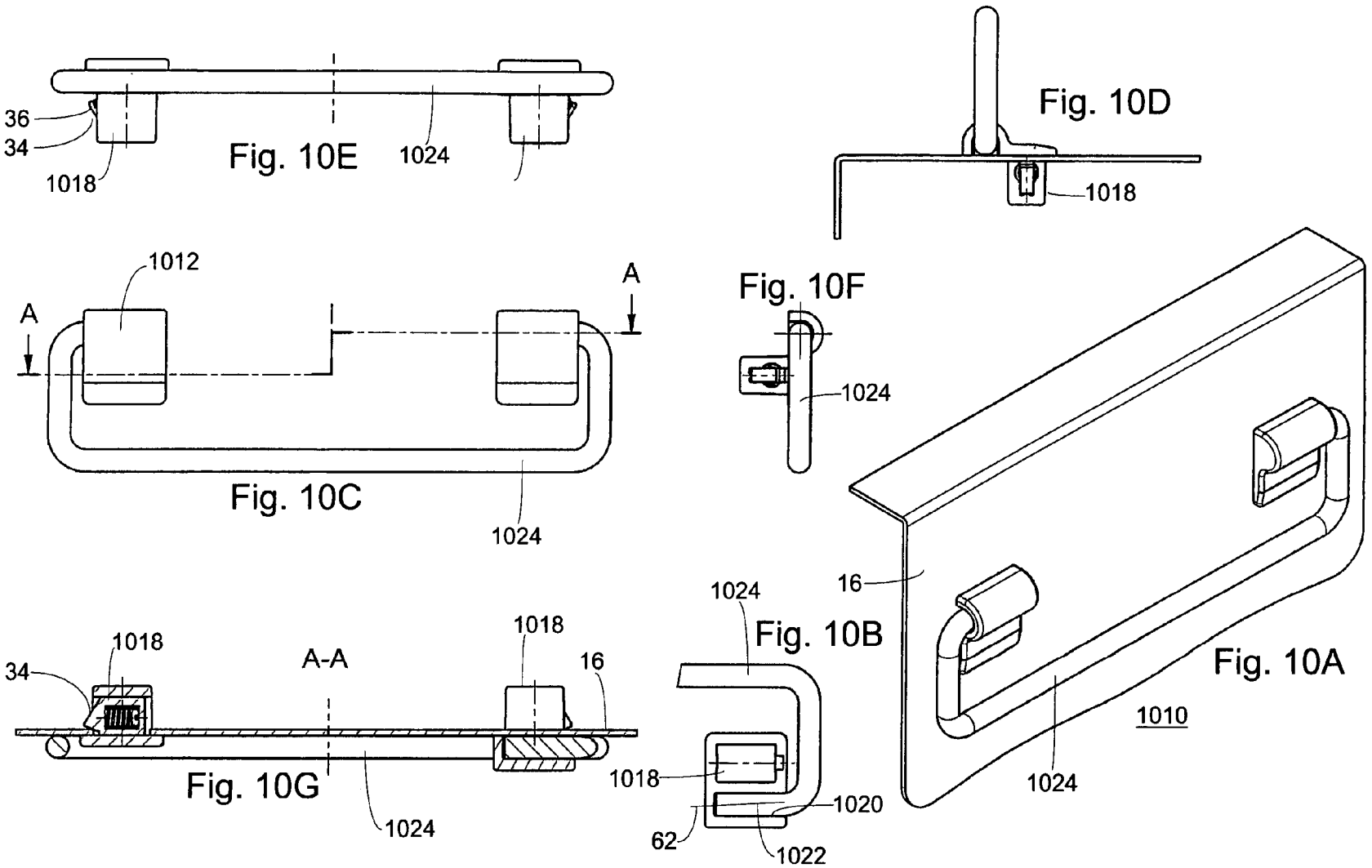
FIGS. 10A to 10G show an embodiment form similar to that in FIGS. 9A to 9F, but without a stop and with another movement direction of the metal plates.

FIGS. 9A to 9F show different views of an embodiment form with C-shaped handle 924 whose ends 922 are held in a holding part 912 with pivot bearing 920 and stop 926, namely, around the axis of rotation 62 between an end position contacting the thin wall 16 which is shown in FIGS. 9A and 9F and the position contacting a stop 926 of the holding part 912 in which the handle 924 is raised, which is shown in FIG. 9D. The metal plate 930 moves inside the snap device 918 in a direction 64 (see FIG. 9B) extending perpendicular to the axis of rotation 62 of the handle and is accordingly especially stable because the metal plate 930 extends with its inclined holding surface 936 particularly close to, and in the loading direction of, the handle end 922 when the latter is folded out according to FIG. 9D and contacts the stop 926 and, in so doing, transmits torsional forces to the holding part 912 in the counterclockwise direction. The holding part delivers these torsional forces to the inner surface of the thin wall 16 via the inclined holding surface 936 and to the outer surface of the thin wall 16 via a support surface 66.

FIGS. 10A to 10G show an embodiment form similar to that in FIGS. 9A to 9F with corresponding reference numbers preceded by 10 instead of 9, but without a stop and with a different movement direction of the metal plates which is less able to withstand loads.

Figure 11:
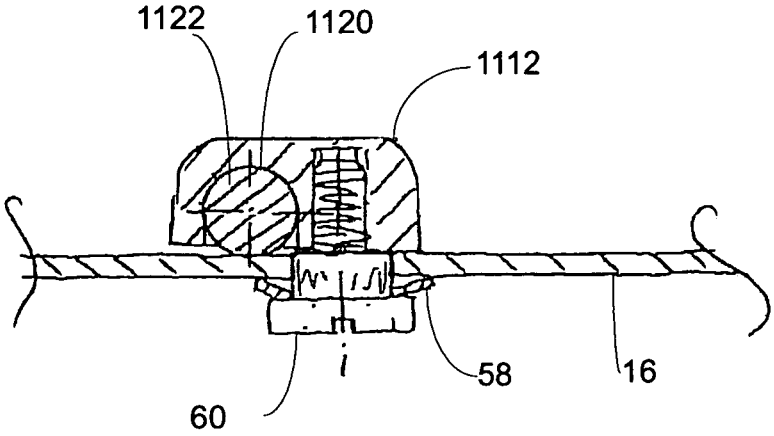
FIG. 11 shows an embodiment form in which a head screw with disk spring is substituted for the metal plates as fastening means.

FIG. 11 shows an embodiment form in which the slide is replaced by a head screw 60 with disk spring 58 as fastening means. The disk spring pulls the screw, which is screwed into the holding part 1112, in direction of the thin wall 16 in such a way that the round handle end 1122 which is supported in the bearing 1120 frictionally contacts the thin wall 16.

COMMERCIAL APPLICABILITY

The handle according to the invention is commercially applicable in switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

REFERENCE NUMBERS

10, 910, 1010 handle, lashing lug, clothes hook
12, 512, 912, 1112 holding part
14 through-hole
16 thin wall
18, 918, 1018 snap devices
20, 920, 1020, 1120 pivot bearing
22, 922, 1022, 1122 end with round cross section
24, 524, 1024 handle of round material
526, 926 ramp, stop
28 side without stop
30 slide
32 slide
34 inclined run-in surface
36, 936, 1036 inclined holding surface
38 edge
40 hearing space of the pivot bearing
42 base
44, 244 groove, notch
46 dimension
48 diameter
50 spring force
52 notch
54 opening
56 plug
58 disk spring
60 head screw
62 axis
64 movement direction of slide
66 support surface

The invention claimed is:

1. A handle assembly in combination with a thin wall comprising:

a handle having two ends, the handle having a round cross section and a diameter;

at least one holding part fastened in a through-hole in the thin wall by means of at least one snap device;

wherein the holding part forms a pivot bearing having an axis, the pivot bearing comprising a groove or notch and a bearing space for at least one end of the handle, the groove or notch having a cross-section that accepts an end of the handle and which opens toward the thin wall; and wherein the snap device comprises:

two metal plates which are supported in a channel of the holding part, a spring forcing the two metal plates in opposite directions, each metal plate having at a free end face comprising a flat inclined run-in surface and a steep inclined holding surface, whereby the plates are configured to have a locking action caused by the spring;

wherein the run-in surfaces and the holding surfaces of the metal plates cooperate with an edge of the through-hole; and wherein the pivot bearing has a depth that is slightly smaller than the diameter of the at least one end of the handle so that the handle frictionally engages the pivot bearing and the wall.

2. The handle according to claim 1;

wherein the handle is bent in a C-shape.

3. The handle according to claim 1;

wherein the movement direction of the plates is parallel or perpendicular to the axis of the pivot hearing.

* * * * *